US008091370B2

(12) United States Patent
Tuthill et al.

(10) Patent No.: US 8,091,370 B2
(45) Date of Patent: Jan. 10, 2012

(54) COMBUSTOR LINER CAP ASSEMBLY

(75) Inventors: Richard S. Tuthill, Bolton, CT (US); Craig F. Smith, Ashford, CT (US)

(73) Assignee: United Technologies Corporation, Hartford, CT (US)

( * ) Notice: Subject to any disclaimer, the term of this patent is extended or adjusted under 35 U.S.C. 154(b) by 796 days.

(21) Appl. No.: 12/132,285

(22) Filed: Jun. 3, 2008

(65) Prior Publication Data

US 2009/0293489 A1 Dec. 3, 2009

(51) Int. Cl.
*F02C 7/20* (2006.01)
*F02C 7/08* (2006.01)

(52) U.S. Cl. ..... 60/796; 60/738

(58) Field of Classification Search ..... 60/737, 60/738, 740, 748, 752, 796, 800
See application file for complete search history.

(56) References Cited

U.S. PATENT DOCUMENTS 5,274,991 A * 1/1994 Fitts ..... 60/800
6,672,073 B2 * 1/2004 Wiebe ..... 60/796
6,715,292 B1 4/2004 Hoke
7,065,873 B2 6/2006 Kang et al.
7,127,899 B2 10/2006 Sprouse et al.
7,134,286 B2 11/2006 Markarian et al.
7,140,189 B2 11/2006 Markarian et al.
7,147,050 B2 12/2006 Kang et al.
7,260,935 B2 8/2007 Colibaba-Evulet et al.
2006/0064987 A1 3/2006 Veninger
2006/0230763 A1 10/2006 Johnson et al.

* cited by examiner

*Primary Examiner* — Ehud Gartenberg
*Assistant Examiner* — Arun Goyal
(74) *Attorney, Agent, or Firm* — Carlson Gaskey & Olds, P.C.

(57) ABSTRACT

A liner cap assembly is disclosed for use in a gas turbine engine combustor. The assembly includes an outer ring that extends along an axis. Multiple struts are circumferentially arranged about an inner diameter of the outer ring and extend radially inwardly therefrom. A plate is supported by and axially aligned with the struts. The plate includes multiple circumferential openings that support a collar and a premix tube at each of the openings. The plate is arranged between leading and trailing edges of the struts to provide a stiffened liner cap assembly that is robust and resistant to the vibrations typically found in dry low NOx systems.

14 Claims, 3 Drawing Sheets

COMBUSTOR LINER CAP ASSEMBLY

BACKGROUND

This disclosure relates generally to a gas turbine engine and more particularly to a liner cap assembly for a gas turbine engine combustor.

Gas turbine engines, preferably of an industrial type, use one or more combustors that burn fuel to rotationally drive a turbine section of the engine. Some combustors include a liner cap assembly at a leading end of the combustor. The liner cap assembly supports fuel injection components, for example.

Many gas turbine engines include a dry low NOx (DLN) system for reducing emissions. Some DLN systems premix the fuel and air prior to their injection as a mixture into the combustion chamber. The DLN systems can create pressure pulsations during combustion that subjects the liner cap assembly to vibratory deformations that are detrimental to component fatigue life and can cause premature failure of the entire combustion system. This effect may be exacerbated if the vibratory frequencies are close to the natural frequency of the liner cap assembly thus shortening part life. To this end, it is desirable to stiffen the liner cap assembly both to strengthen it and to raise its natural frequency above the likely frequencies of the DLN pressure pulsations.

SUMMARY

A liner cap assembly is disclosed for use in a gas turbine engine combustor. The assembly includes an outer ring that extends along an axis. Multiple struts are arranged circumferentially about an inner diameter of the outer ring and extend radially inwardly therefrom. An inner ring and a plate are supported by the struts. The plate is arranged with the inner ring so that it is aligned axially with the struts. The plate includes multiple circumferential openings that support a collar and a premix tube at each of the openings. The plate is arranged between leading and trailing edges of the struts to provide a stiffened liner cap assembly that is robust and resistant to the vibrations typically found in dry low NOx systems.

Other advantages of the disclosure can be understood by reference to the following detailed description when considered in connection with the accompanying drawings.

DETAILED DESCRIPTION

Figure 1:
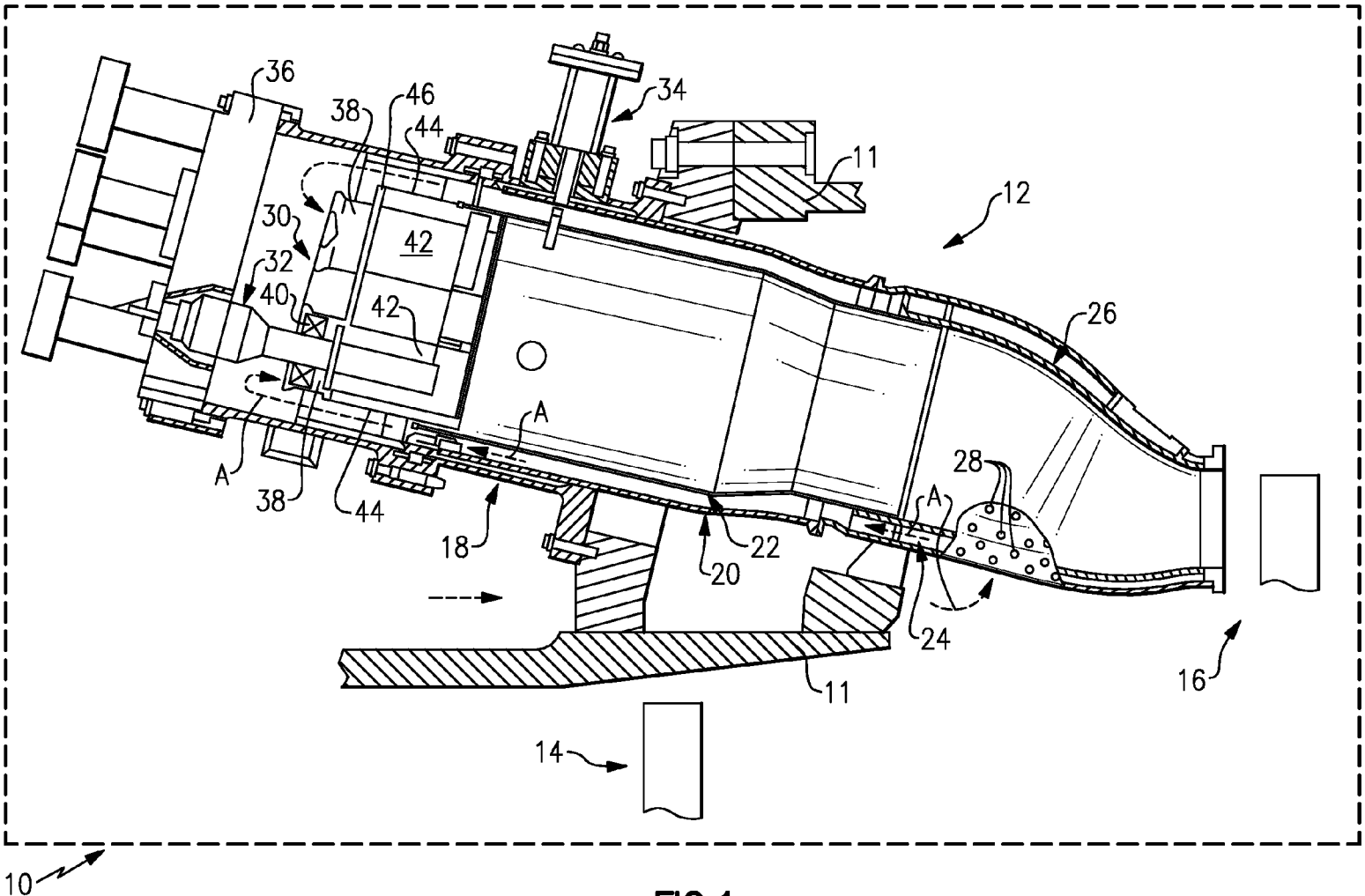
FIG. 1 is a cross-sectional view of a combustor for an industrial gas turbine engine, including a liner cap assembly.

An industrial gas turbine engine 10 is schematically shown in FIG. 1. The engine 10 includes one or more combustors 12 (only one shown) arranged between compressor and turbine sections 14, 16. The combustor 12 is secured to structure 11 of the engine 10. The combustor 12 receives air A from the compressor section 14. The air is mixed with fuel and ignited, as is known, to rotationally drive the turbine section 16.

The combustor 12 includes a combustor housing 18 that is secured to the structure 11. The combustor housing 18 includes an outer sleeve 20 that is arranged about a liner 22 that provides the combustion chamber, providing an annular passage 24. The outer sleeve 20 includes multiple holes 28 that permit the air A to enter the annular passage 24.

A liner cap assembly 30 is received by the outer sleeve 20 and secured to the combustor housing 18. The liner cap assembly 30 receives multiple fuel injectors 32, in one example, five injectors. The fuel injectors 32 deliver fuel to premix tubes 42 and then to the combustion chamber, where it is ignited by an igniter 34. The combusted mixture is delivered through a transition duct 26 to the turbine section 16 where it is expanded to rotationally drive the turbine section 16. A cover 36 is arranged over a forward end of the combustor housing 18 to support the fuel injectors 32.

The liner cap assembly 30 includes multiple collars 38, which receive the fuel injectors 32. A swirler 40 is arranged within each collar 38 about its respective fuel injector 32, in one example. The swirler 40 swirls the air A as it enters each passageway provided by its respective collar 38, which are generally cylindrical in shape. The collars 38 are mounted to a plate 46 that supports generally cylindrical premix tubes 42 that are arranged coaxially with their respective collar 38. The swirler 40 and premix tubes 42 of the liner cap assembly 30 provide swirling fuel-air mixtures to the combustion chamber 20 where they are burned. However, such dry low NOx systems can subject the liner cap assembly 30 to detrimental vibrations. To this end, it is desirable to provide a robust liner cap assembly 30 with resonant frequencies high enough that the resonance will not be excited by the DLN pressure pulsations.

Figure 2:
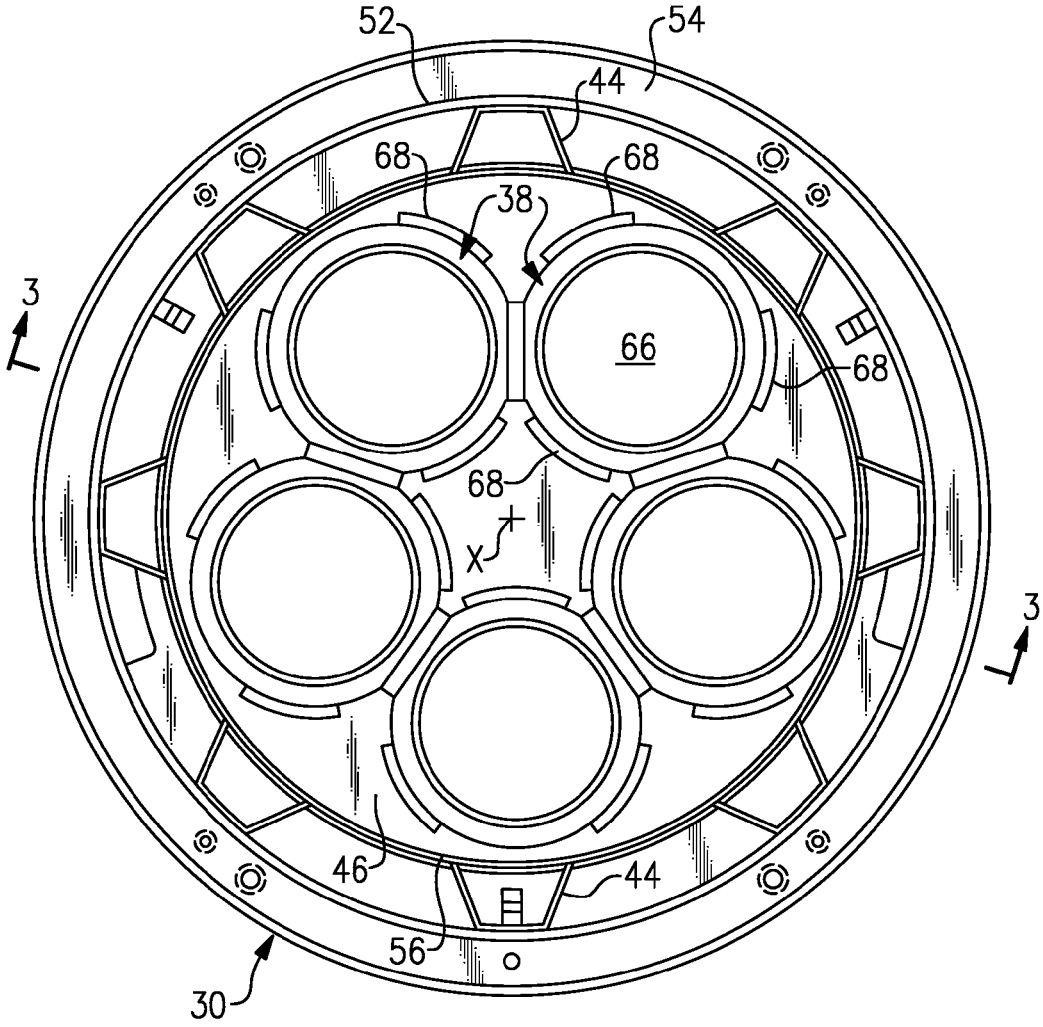
FIG. 2 is an end view of the liner cap assembly shown in FIG. 1.
Figure 3:
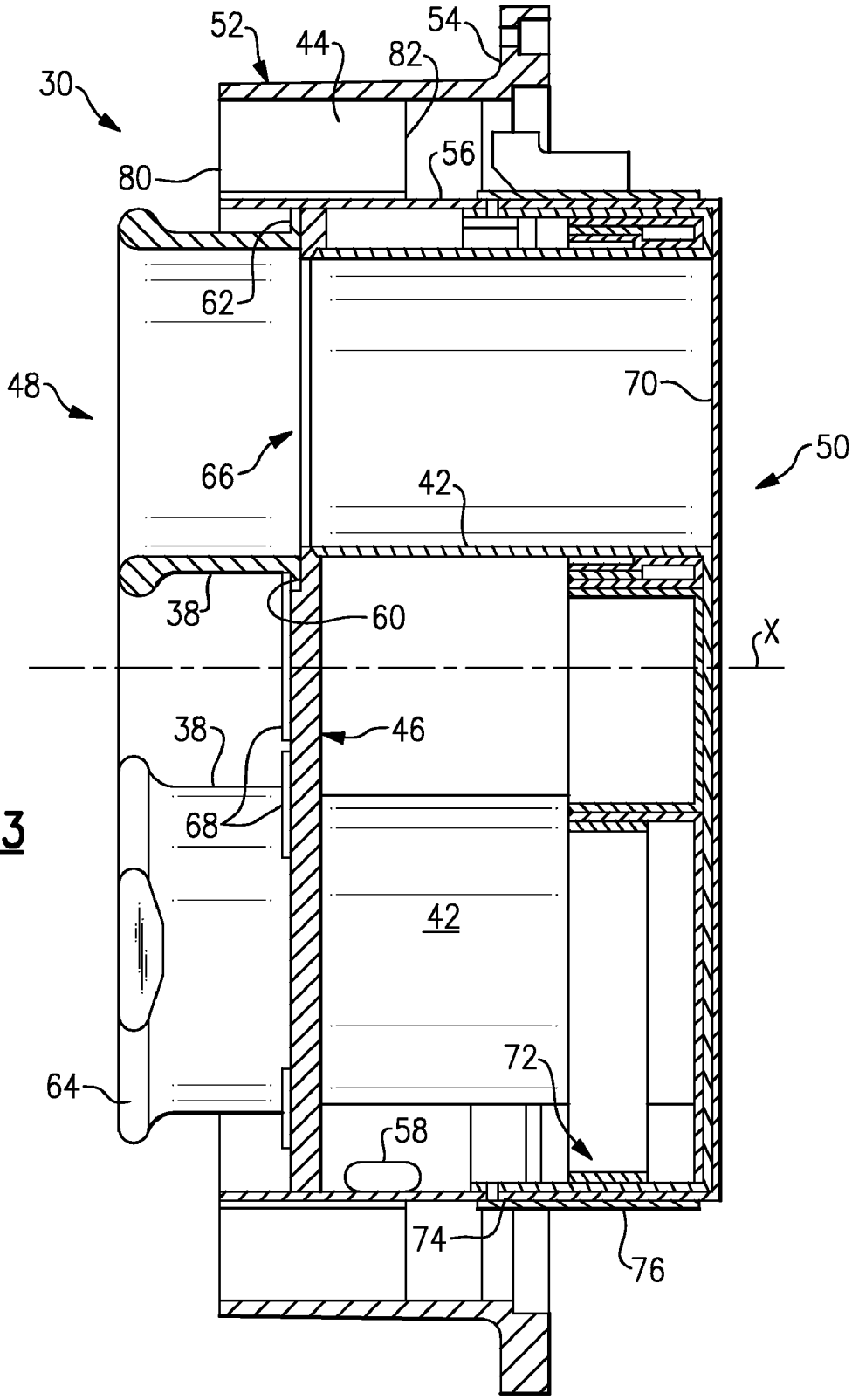
FIG. 3 is a cross-sectional view of the liner cap assembly taken along line 3-3 in FIG. 2.

Referring to FIGS. 2 and 3, the liner cap assembly 30 includes leading and trailing ends 48, 50 through which the air A respectively enters and exits. An outer ring 52 of the liner cap assembly 30 includes a flange 54 that is used to secure the liner cap assembly 30 to the combustor housing 18. Multiple struts 44 are arranged circumferentially about the outer ring 52 and are secured at its inner diameter. In one example, the struts 44 are generally trapezoidal in shape. The plate 46 is axially aligned with the struts 44 and secured axially relative to an axis X between their leading and trailing edges 80, 82. An inner ring 56 is secured to the plate 46, for example, by welding. The struts 44 are secured to the inner ring 56, for example, by welding. The plate 46 is perpendicular to the wall of both the inner ring 56 and the outer ring 52 with struts 44 between them. This arrangement results in a very stiff structure that allows the combustor housing 18 and structure 11 to resist the pressure pulsation induced vibrations of the liner cap assembly 30. With the plate 46 in the example position shown, the liner cap assembly 30 is capable of withstanding significant pressure pulsations during combustion in dry low NOx systems.

The plate 46 includes circumferentially arranged openings 66. One side of the plate 46 includes an annular recess 60 about each opening 66 that receives an outwardly extending radial lip 62 at one end of the collar 38. Tabs 68 are arranged over the radial lip 62 and secured to the plate 46, for example, by welding, to retain the collar 38 relative thereto. The collar 38 extends from the radial lip 62 to an end 64 that receives the fuel injector 32 and swirler 40.

The inner ring 56 is arranged within the outer ring 52 and is coaxial with it about an axis X. In one example, the inner ring 56 extends from and is supported by the plate 46 on a side opposite the side that supports the collars 38. The premix tubes 42 are aligned with their respective openings 66 and arranged radially inwardly of the inner ring 56. The premix tubes 42 extend axially from the plate 46 to a rear plate 70. Further, the inner ring 56 may include cooling holes 58 allowing compressor air to flow into the liner cap assembly 30.

An impingement plate subassembly 72 is secured to the inner ring 56 by fasteners 74. A spring 76 is supported on an outer surface of the impingement plate subassembly 72. The spring 76 is received by the outer sleeve 20 (FIG. 1) to secure it to the liner cap assembly 30.

Although an example embodiment has been disclosed, a worker of ordinary skill in this art would recognize that certain modifications would come within the scope of the claims. For that reason, the following claims should be studied to determine their true scope and content.

What is claimed is:

1. A liner cap assembly for a gas turbine engine combustor comprising:

an outer ring extending along an axis;

a strut secured relative to and extending radially inwardly from the outer ring, the strut including leading and trailing edges;

an inner ring secured to the strut and disposed radially inwardly of the outer ring; and a plate supported by the inner ring and aligned axially with the strut, the plate having multiple circumferentially arranged openings, the plate being disposed axially between the leading and trailing edges of the strut.

2. The assembly according to claim 1, comprising a collar supported by the plate at each opening.

3. The assembly according to claim 2, comprising a premix tube supported by the plate opposite the collar at each opening.

4. The assembly according to claim 3, wherein the inner ring extends axially from the plate to a trailing end.

5. The assembly according to claim 4, comprising an impingement plate subassembly secured to the inner ring near the trailing end.

6. The assembly according to claim 5, comprising a combustor housing and a spring supported by the impingement plate subassembly, the impingement plate subassembly securing the liner cap assembly to the combustor housing.

7. The assembly according to claim 4, comprising a rear plate arranged at the trailing end, the premix tube extending between the plate and the rear plate.

8. The assembly according to claim 2, comprising a tab secured to the plate about each collar and configured to retain the collars to the plate.

9. The assembly according to claim 1, wherein multiple struts are arranged circumferentially between the outer ring and plate.

10. The assembly according to claim 9, wherein the struts are generally trapezoidal in shape.

11. The assembly according to claim 1, comprising an annular flange of the outer ring projecting radially outwardly.

12. A liner cap assembly for a gas turbine engine combustor comprising:

an outer ring extending along an axis;

multiple circumferentially arranged struts secured to the outer ring and extending radially inwardly there from, the struts including leading and trailing edges;

an inner ring secured to the strut and disposed radially inwardly of the outer ring;

a plate supported axially between the leading and trailing edges, the plate having multiple circumferentially arranged openings;

a collar supported by the plate at each opening; and a premix tube supported by the plate extending in a direction opposite the collar at each opening.

13. The assembly according to claim 12, wherein the inner ring extends axially from the plate to a trailing end and a rear plate arranged at the trailing end, the premix tubes extending between the plate and the rear plate inside the inner ring.

14. The assembly according to claim 13, wherein the inner ring is supported inside the outer ring by the struts.

* * * * *